United States Patent [19]

Scholtes et al.

[11] Patent Number: 4,940,869

[45] Date of Patent: Jul. 10, 1990

[54] COMBINATION CONVECTION AND MICROWAVE OVEN HAVING IMPROVED MICROWAVE ENERGY DISTRIBUTION

[75] Inventors: Pierre Scholtes, Thionville; Michel Hoffmann, Cattenom, both of France

[73] Assignee: Scholtes, Thionville, France

[21] Appl. No.: 413,906

[22] Filed: Sep. 28, 1989

[30] Foreign Application Priority Data

Sep. 29, 1988 [FR] France ..... 88 12759

[51] Int. Cl.[5] ..... F05B 6/72

[52] U.S. Cl. ..... 219/10.55 F; 219/10.55 R; 219/10.55 E; 219/400; 126/21 A

[58] Field of Search ..... 219/10.55 F, 10.55 R, 219/10.55 B, 10.55 E, 400; 126/21 A

[56] References Cited

U.S. PATENT DOCUMENTS 4,335,290 6/1982 Teich ..... 219/10.55 F
4,477,706 10/1984 Mittelsteadt ..... 219/10.55 B
4,481,396 11/1984 Matsubayashi et al. ..... 219/10.55 B
4,556,772 12/1985 McCammon et al. ..... 219/10.55 F
4,591,683 5/1986 Eke ..... 219/10.55 B
4,849,592 7/1989 Claesson et al. ..... 219/10.55 F

*Primary Examiner*—Philip H. Leung
*Attorney, Agent, or Firm*—Pollock, VandeSande & Priddy

[57] ABSTRACT

A cooking oven having both conventional heating as well as microwave heating. The oven muffle includes a metal distribution sheet along a back wall, forming a cavity with the back wall. A bladed turbine fan is included within the cavity, driven by an electric motor. Microwave energy is introduced into the cavity through a waveguide having an exit iris in the cavity. Microwave energy entering the cavity exits through openings in the metallic distribution sheet, as well as past the rotating turbine blade through additional holes in the distribution sheet. The microwave energy exiting the distribution plate provides for a better cooking energy distribution throughout the oven.

13 Claims, 5 Drawing Sheets

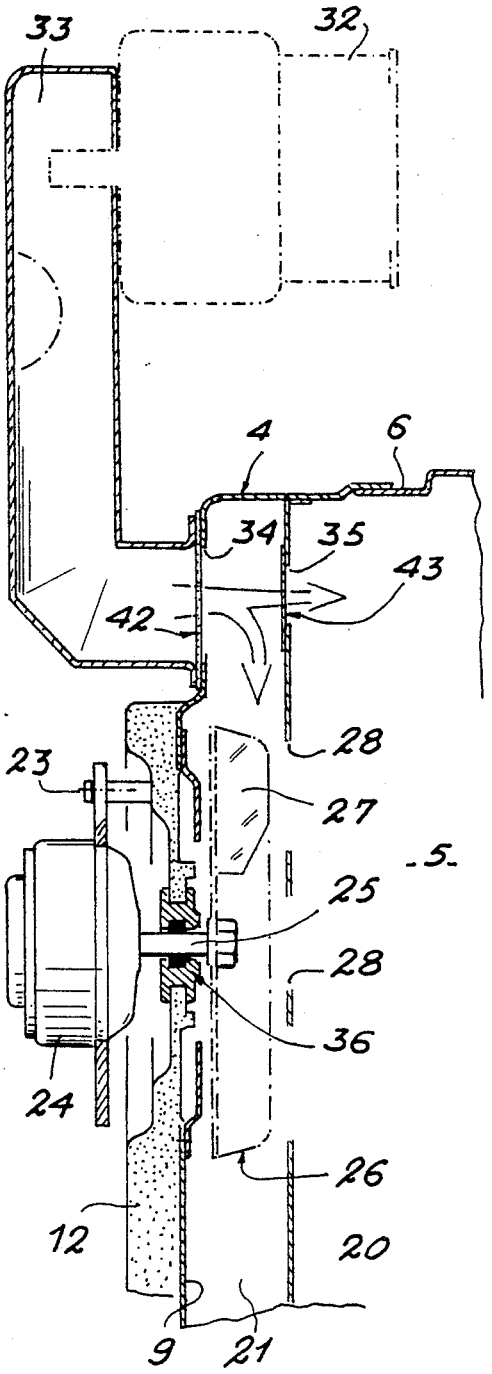
FIG. 3
FIG. 4
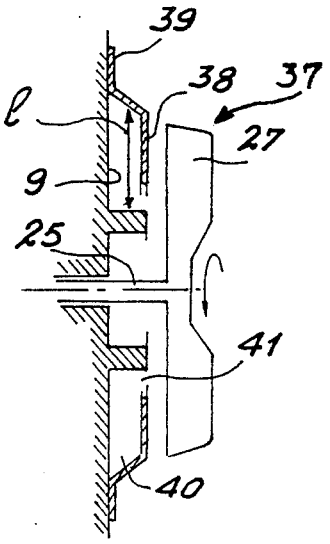

COMBINATION CONVECTION AND MICROWAVE OVEN HAVING IMPROVED MICROWAVE ENERGY DISTRIBUTION

BACKGROUND OF THE INVENTION

The present invention relates to a microwave oven and, still more particularly, concerns a dual-purpose oven combining heating by UH frequency energy with a traditional heat energy input by heating resistors and convection of the internal atmosphere of the oven.

So-called microwave ovens are already known in the art, where the electromagnetic waves supplied by a suitable source and channelled in a guide which opens into the oven cavity are distributed in the latter by various methods. One of the latter consists in arranging in this cavity or oven muffle, in the vicinity of the exit iris for the waves leaving the guide, a metal-bladed propeller which is driven in rotation and which the microwaves leaving the guide strike, changing phase and being then reflected in directions which vary at each moment because of the relative inclination of the blades and because of their drive. This results in a random distribution of the field in the oven cavity, avoiding the presence of cold and hot regions generated, respectively, by the nodes and the antinodes of the electrical field and producing a more uniform energy distribution. However, this solution which requires the oven to be provided with a specially adapted motor and propeller, appreciably increases the cost of manufacture of the whole unit. Furthermore, the metallic material of the propeller, usually aluminium sheet, undergoes appreciable distortions at high temperature, and this can result in the formation of electrical arcing or, equally, can cause the propeller to jam, this being so especially in so-called pyrolysis ovens where the temperature can locally reach 500° C. or more.

To reduce the cost of such ovens, provision has also been made for eliminating the motor driving the fan purpose oven with traditional cooking, due to an appreciable loss of the heat energy from the oven as soon as the driving air is introduced.

Another traditional solution also consists in providing the oven muffle with a rotating tray supporting the contents to be heated. The waves, which are established in the oven in a nonuniform manner with a succession of hot and cold spots, in combination with the tray rotation, produce a continuous variation in the position of the energy maxima and minima within the contents which, overall, receive an approximately uniform energy. However, here again, the device requires an additional motor for driving the tray, and the fitting of a wave trap on the shaft of the latter in order to avoid the harmful escape of a proportion of the UH frequency energy along this shaft. Moreover, there is a risk that the tray and its drive shaft may distort at high temperature, while the presence of this tray limits the working capacity of the muffle in any case, this being reduced to that of the cylinder whose radius is equal to the distance from the centre of rotation of the tray to the nearest internal wall of the muffle.

Finally, there are known embodiments where the distribution of the flux of electromagnetic waves in the oven cavity is produced by means of a rotating antenna mounted in the region where the guide opens into the muffle, so as to trap the energy leaving the latter and to radiate it into the oven cavity in a more uniform distribution. However, here too, disadvantages continue to exist, resulting from the need to provide a rotary coupling between the cavity and the guide, with the use of a shaft made of dielectric material and driven by a motor outside the guide, the antenna consisting of a bent metal tube associated with a ceramic or similar seal in order to prevent the loss of waves at the exit of this guide. Furthermore, while this device is suitable when the oven operates exclusively on microwave energy, it is not suitable for a dual-purpose oven, in which, in particular, the problems of expansion between the metal and ceramic parts, especially during the pyrolysis stages, lead to difficulties which are considerable and tricky to overcome. In addition, the rotating antenna in such ovens is generally situated in the vault of the muffle in the vicinity of the grill resistor, and this further increases the problem of temperature behaviour. Finally, this device is costly and, once again, appreciably reduces the working volume of the muffle.

SUMMARY OF THE INVENTION

The present invention relates to an aven with heating by means of microwaves, combined with traditional heating, which overcomes the disadvantages of the solutions which are known in the art, by permitting a uniform distribution of the electromagnetic field in the oven muffle without, however, reducing the working volume of the latter and without disturbing the path of the convection currents which product a continuous air circulation in the oven to distribute the heat energy supplied by the heating resistors and by the grill resistor with which the upper part of the oven muffle is usually equipped.

For this purpose, the oven under consideration, comprising a muffle with preferably lagged walls, a facing front door, side walls, a lower sole plate and an upper vault, and a back wall, a metallic distribution sheet defining between it and the back wall a cavity in which there is mounted the bladed turbine of a fan, firmly fixed to a shaft passing through the back wall and driven by an electrical motor arranged on the opposite side of the cavity in relation to this wall, this metallic sheet comprising orifices distributed so as to permit the convection, forced by the turbine, of a stream of air drawn in preferably through the central part of the metallic sheet and expelled in the vicinity of its lateral sides and optionally towards the sole plate and the vault of the muffle, and at least one source of UH frequency waves which is situated outside the muffle and associated with a waveguide which opens into the muffle through at least one exit iris, is characterized in that the wave exit iris is situated in the back wall of the muffle facing a passage provided in the metallic distribution sheet, so that the wave flux is divided between a first fraction entering the muffle through this passage and a second fraction which is distributed in the cavity behind the metallic sheet where the turbine of the fan is situated, striking its blades, the metallic distribution sheet being pierced with holes, each forming a rudimentary exit iris for the waves towards the interior of the muffle.

Thus, in a traditional cooking oven, comprising a ventilation assembly creating a forced convection in the muffle atmosphere, the invention makes it possible to produce additional heating by UH frequency energy, ensuring an improved field distribution in the muffle by virtue of components which already exist in the oven cavity, in particular by means of the blades of the ventilation turbine.

In contrast to the conventional dual-purpose ovens which completely separate the waveguide exit orifice with regard to the oven region in which the fan producing the forced convection of the oven atmosphere is situated, the invention provides especially in making these components interact by using the blades of this fan directly to improve the spatial distribution of the microwaves.

According to a particular characteristic of the oven in question, the holes arranged in the metallic distribution sheet for distributing the microwaves towards the interior of the muffle have an elongate, especially oblong, shape, arranged to produce, when the waves pass through them, an electrical field which is in quadrature in relation to its orientation, in line with the guide exit iris and with the facing passage provided in the distribution sheet.

According to various embodiments, the holes in the distribution sheet can have an oblong shape with their major axis vertical, perpendicular to the horizontal transverse direction of the longest dimension of the guide, and can be arranged along radii which are uniformly distributed around the centre of the distribution sheet or else can be present with an inclination which is tangent to concentric circles arranged around the centre of the metal sheet. According to yet another alternative embodiment, the holes arranged in the distribution sheet may be inclined to the vertical and arranged quincuncially.

In another embodiment, the distribution sheet comprises a single central hole in combination with perforations arranged in the lateral sides and optionally the lower side of the metallic sheet.

According to another characteristic of the invention, the exit iris of the guide and the facing passage provided in the distribution sheet are closed by small plates of a material which is transparent to microwaves, producing the leakproofing of the cavity defined between the back wall and the metallic sheet. The material of the small plates is advantangeously mica, or consists of a similar material having equivalent dielectric properties.

According to yet another characteristic, the exit iris and the facing passage have relative dimensions which are determined to ensure a suitable impedance matching and are preferably arranged in the vicinity of the muffle vault, in the middle part thereof.

The oven under consideration preferably comprises a source of UH frequency waves, consisting especially of a magnetron mounted within the thickness of the muffle wall. The turbine shaft driven by the motor is also advantageously associated with a quarter-wave trap preventing energy leakages along this shaft, outside the muffle.

Other characteristics of a dual-purpose oven with microwaves and traditional heating established in accordance with the invention will also become a apparent through the description which follows, of an embodiment and of various alternatives forms thereof, which are given by way of guidance without any limitations being implied, with reference to the attached drawings.

BRIEF DESCRIPTION OF THE FIGURES

FIG. 3 is a larger scale sectional view of a detail of the oven under consideration.

FIG. 4 illustrates another detail of the oven on a still larger scale.

DESCRIPTION OF THE PREFERRED EMBODIMENT

Figure 1:
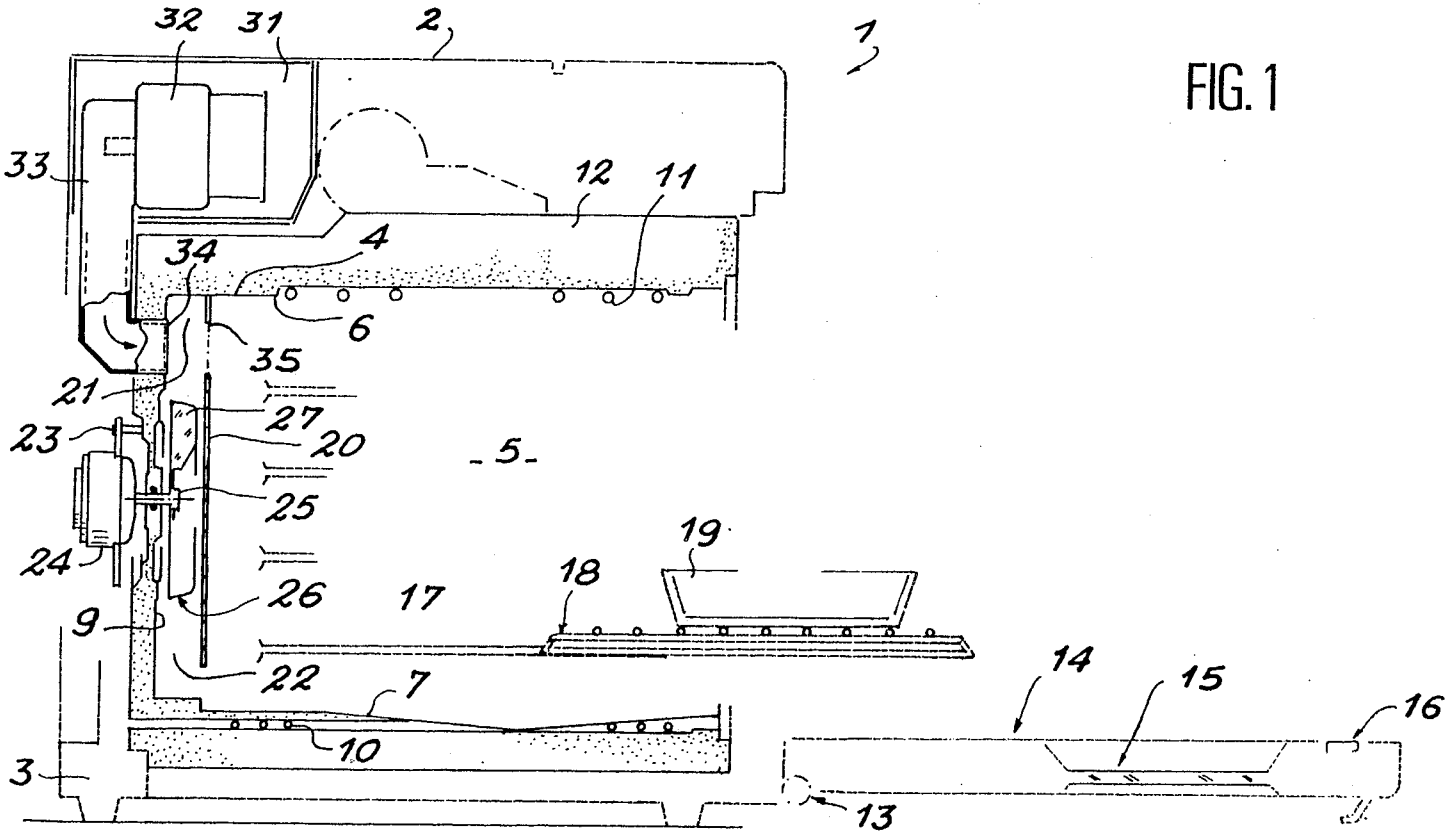
FIG. 1 is a diagrammatic view, in cross-section, of a dual-purpose oven constructed in accordance with the invention.
Figure 2:
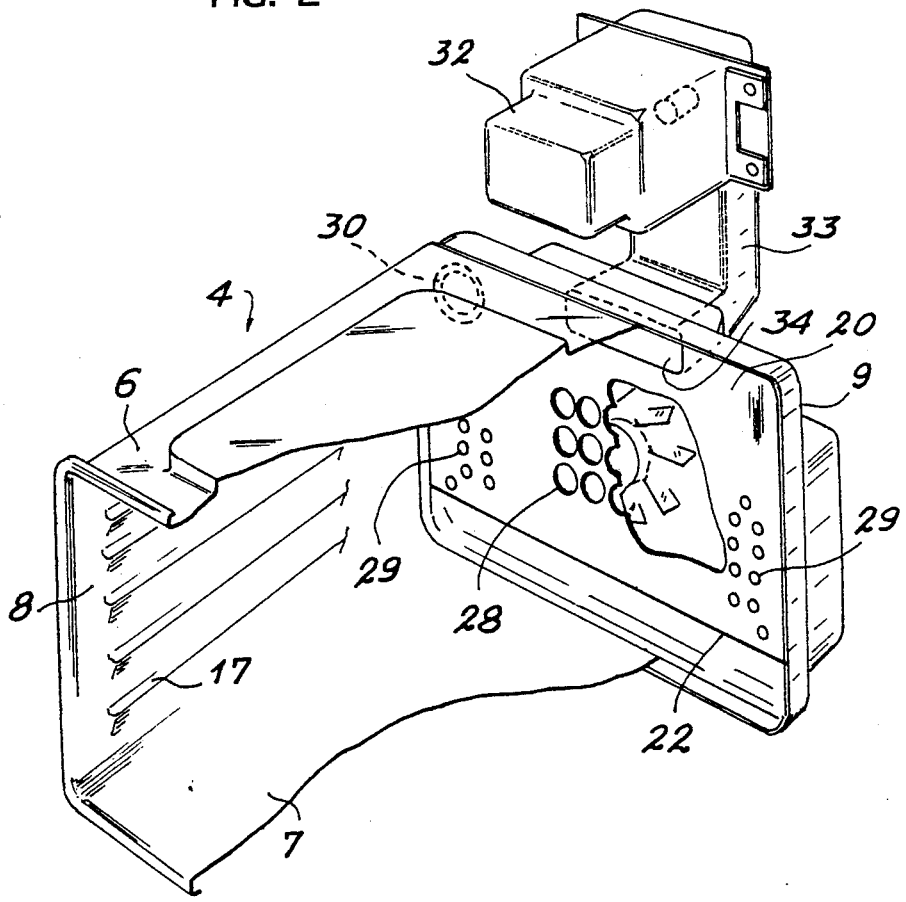
FIG. 2 is a perspective view, with partial cutaway, of the muffle of the oven of FIG. 1.

As can be seen particularly in FIGS. 1 and 2, the oven under consideration, indicated as a whole by reference 1, consists chiefly of an outer enclosure 2, usually equipped at its lower end with supporting studs 3. A muffle 4 is mounted inside the casing 2, defining internally a cavity 5 where cooking of the food takes place. The muffle 4, generally produced using a stamped metal sheet, comprises an upper wall or vault 6 and a lower wall or sole plate 7, and side walls 8 and, lastly, a back wall 9. The lower and side walls of the muffle are associated, outside the cavity 5, with electrical resistors 10 making it possible, in conventional cooking, to ensure the heating of the internal atmosphere of this cavity and, in particular, by means of a circulation maintained as will be seen later, to produce a phenomenon known as rotating heat in the cavity. In addition, and also in a known manner, the muffle comprises another resistor 11 or grill resistor, of high power, inside the cavity 5 and housed under the upper vault 6. The muffle 4 is surrounded externally by a thickness 12 of a suitable lagging material, the casing 2 moreover comprising a door 14, articulated on hinges 13 arranged in front of the casing 2 and closing the muffle 4 when the oven is in use or permitting, in the open position, free access to its interior. The door 14 also generally comprises a window 14 enabling the user to view directly the interior of the muffle and the food being cooked.

One or more buffers 16 are provided on the inner face of the door 14, actuating contacts, not shown, situated on both sides of the muffle in order to disconnect the microwave energy supply when the door is opened. Also arranged in the side walls 8 of the muffle 4 are relief parts 17 forming slides for guiding, inside the cavity 5, a tray 18 supporting a cooking utensil 19.

The back wall 9 of the muffle 4 is associated with a metallic protective and distribution sheet 20 extending parallel to this wall and arranged inside the cavity 5 slightly forward into the muffle, so as to define a space 21 with the wall 9. The distribution sheet 20 can extend from the upper wall 6 of the muffle 4 as far as its lower wall 7 or else, as in the example shown, can stop at a certain distance from the latter, to define a slot 22 for circulating the atmosphere of the muffle.

In order to produce this circulation in particular, the oven comprises, in a manner which is known per se, behind the casing 2, a mounting 23 for an electrical motor 24 whose shaft 25 passes through the back wall 9 of the muffle and at its end carries a turbine 26 of a fan whose blades 27 are distributed round the shaft 25. The turbine 26 rotates about itself in the space 21, being protected by the metallic sheet 20, and is arranged so that, depending on the direction of its rotation and the direction of the blades 27, it draws in the air present in the cavity 5 of the muffle 4, especially through orifices 28 arranged in the distribution sheet 20 in the centre of the latter, this air being subsequently blown back into the cavity through the slot 22 provided at the base of the sheet 20, and through other holes 29 arranged on the sides of this sheet, in the vicinity of the side walls 8. An illuminating lamp 30, shown diagrammatically in FIG. 2, is fitted in the back 9 of the muffle 4 and preferably in a corner thereof, this lamp making it possible to see the progress of the cooking of the food in the oven through the door window 15.

The oven 1 described briefly above is, in actual fact, a dual-purpose oven, which combines heating of the food to be cooked by convection of the heat energies supplied by the heating resistors 10, where appropriate by the grill resistor 11, according to a circulation maintained by the turbine 26, with microwave heating, by virtue of a suitable electromagnetic field which is established in the cavity.

To this end, the oven casing 2 comprises, outside the muffle 4, a housing 31 in which a source of high-frequency electromagnetic waves is mounted, in the present case a magnetron 32, feeding a guide 33. The latter is appropriately bent and dimensioned so that the wave flux issuing from the magnetron 32 is delivered into the muffle 4 through an iris 34 provided at the guide exit, this iris 34 being arranged, in accordance with the invention, in line with the space 21 and containing the turbine 26 of the fan for circulating the atmosphere of the muffle.

In particular, the iris 34 is arranged in the middle part of the muffle and preferably in the vicinity of its vault, so that the microwave flux issuing from the guide 33 as it enters the cavity 5 is divided, in fact, on passing through the space 21, into two secondary fluxes, one of which is transmitted directly into the cavity through a passage opening 35, arranged facing the distribution sheet 20, while the other enters the space 21, encountering the blades 27 of the turbine 26. Since the latter is driven in rotation, the relative direction of the blades is continually changed; the characteristics of the wave flux are thus changing all the time, producing an effective mixing not only in the space 21 but also in the whole cavity 5.

Figure 5A:
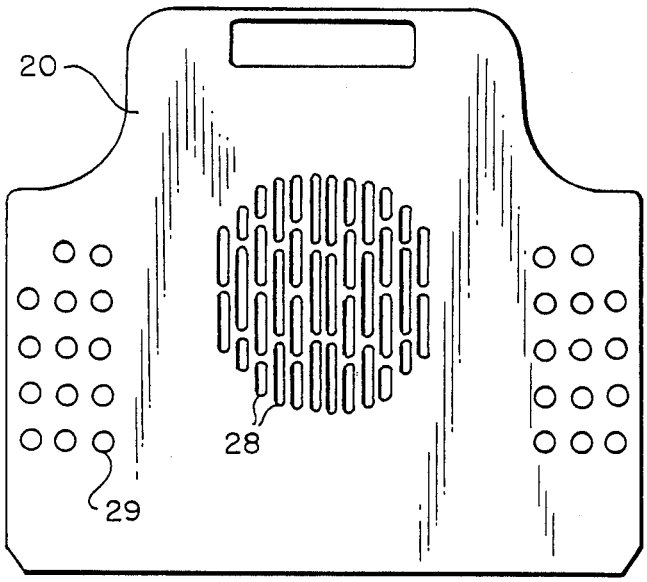
FIGS. 5A and 5B, on the one hand, and 5C and 5D, on the other hand, are front half-views of the metallic distribution sheet of the muffle of the oven, illustrating various alternative embodiments of the holes arranged through this metal sheet.
Figure 5C:
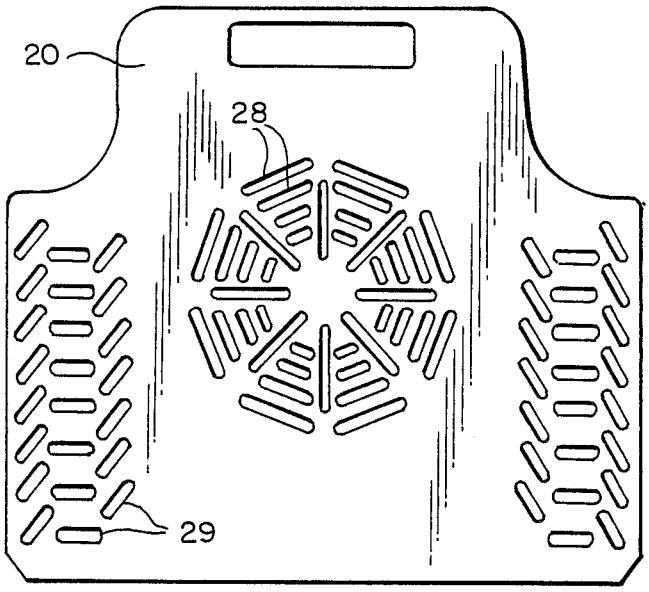
Figure 5B:
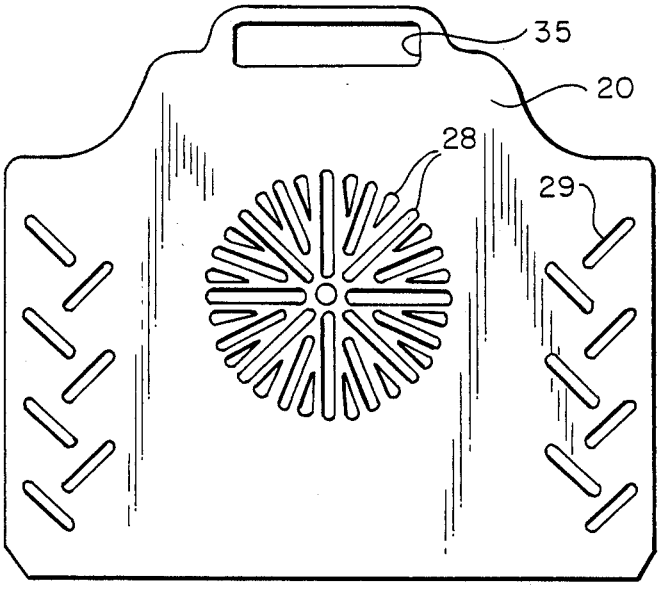
Figure 5D:
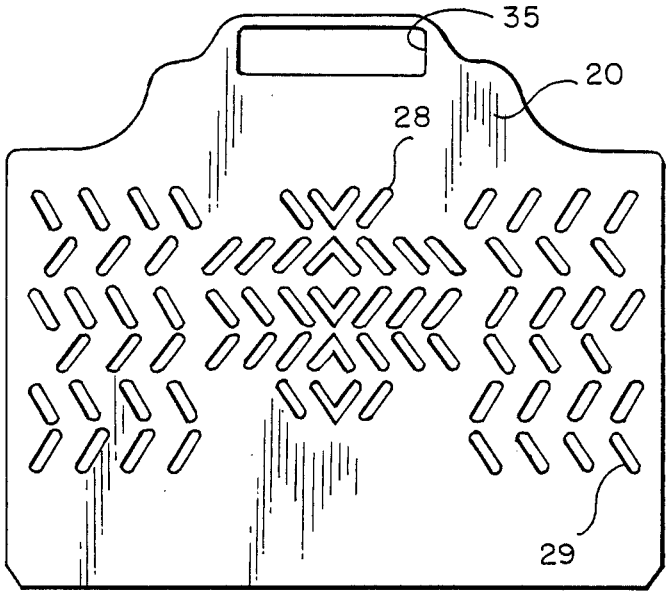

Furthermore, in accordance with another major characteristic of the invention, the holes 28 and 29 arranged in the distribution sheet 20, in the centre and on the sides of the latter respectively, are designed also to affect the microwave flux which is thus modified. In particular, each hole can be considered to be a rudimentary iris through which the waves enter the cavity 5 through the sheet 20. In these conditions, each of them forms an individual source whose characteristics are a function of the shape of these holes, directly influencing the wave propagation in the cavity. In fact, on passing through these holes, the electrical field is oriented in accordance with their individual shape. In particular, to obtain an electrical field in quadrature in relation to the orientation which it has on leaving the guide 33, the holes provided in the centre of the distribution sheet 20 and, if applicable, the side holes 29, are advantageously given an oblong or elongate shape whose dimensions can be determined in each case, according to each application and, in particular, the power of the source of microwaves and the volume of the oven cavity. FIGS. 5A to 5D thus show various alternative forms of embodiment, among others, in which the holes 28 and/or 29 are, depending on the case, distributed vertically (FIG. 5A), along radii starting at a central point of the sheet 20 (FIG. 5B), having an inclination tangent to concentric circles whose centre is substantially in the middle of the distribution sheet (FIG. 5C), or else are arranged quincuncially or with variable and opposed orientations in successive and superposed rows, these holes being suitably inclined to the vertical (FIG. 5D). Provision could also be made to produce a single central hole of larger size in the sheet and smaller holes distributed in the lateral sides of the sheet. The shape and distribution of the holes in the sheet 20 actually vary each time as a function of the metering to be produced between that part of the flux originating from the guide 33 which enters the muffle cavity 5 directly and that which is mixed by the fan blades in the space 21.

FIG. 3 illustrates, furthermore, other arrangements advantageously employed whatever the embodiment adopted for the distribution of the holes 28 and 29 in the sheet 20. This arrangement prevents the proportion of the flux which is collected in the space 21 from escaping outwards, especially through the passage of the shaft 25 of the motor 24 driving the turbine 26. A seal 36 producing a suitable leakproofing in respect of the gases and circuit vapours, this seal being provided in the back wall 9. A wave trap 37 of the quarter-wave trap type is mounted around the shaft 25 for this purpose, comprising a metal sheet component 38 which is attached onto the wall and whose edge 39 is applied against the latter. The metal sheet 38 is shaped so as to define with the back wall 9 of the muffle an auxiliary cavity 40 (FIG. 4) whose length, referred to diagrammatically by 1 on the drawing, is equal to $\lambda/4$. In this cavity, the incident wave originating from the space 21 and the wave reflected by the walls of this cavity are opposite in phase. This results in the electrical field being cancelled out in the region 41 at the exit of the cavity 40, preventing the propagation of electromagnetic waves outwards from the cavity 2 along the shaft 25. In the iris 34 and the facing passage 35, the distribution sheet 20 also preferably comprises small plates, 42 and 43 respectively, made of mica or of another dielectric material transparent to microwaves, which close the guide and the space, preventing entrance of any materials originating from the products placed in the oven cavity to be cooked.

Thus, in accordance with the invention, a dual-purpose oven is produced, combining a conventional heating device with rotating heat and a microwave system in a traditional muffle with a fan and a metallic distribution sheet, the fan turbine simultaneously producing the homogeneous dispersion of these microwaves in the cavity without any special adaptation. The exit of the guide connected to the source of UH frequency waves is arranged so that it is in this case no longer situated in the ceiling of the muffle, as is generally the case in the traditional construction, but behind the distribution sheet. The turbine employed, in particular, may be of a standard design, the only precaution to be taken being that it should not have sharp edges, to avoid the generation of interfering and dangerous electrical arcing. The working volume of the oven remains unchanged, while the efficiency of microwave heating is considerably improved by the homogeneous distribution of the electrical field, this distribution being produced directly using already existing parts and components and without being accompanied by any change in the performance obtained in traditional cooking which can, if required, be done additionally or, on the contrary, separately.

The reliability of the hardware employed with regard to temperature is not changed, nor is there resistance to impacts and to vibrations. The fan, whose function remains essentially that of distributing the temperatures in normal cooking, is also responsible for the balanced distribution of the electromagnetic energy in microwave cooking, by mixing the fraction thereof which is diverted into the space where this fan is mounted before retransmitting it into the muffle space.

Naturally and obviously, it must be considered that the invention is not limited in any way to the embodiment described and to the various embodiments illustrated in the drawings; on the contrary, it includes all alternative forms thereof; in particular, the distribution sheet may be made of materials having low dielectric losses and producing limited reflections of electromagnetic waves, these reflections taking place chiefly on the fan blades.

We claim:

1. A cooking oven having both conventional heating using rotating heat, and microwave heating, comprising:

a muffle having a front door, side walls, a lower sole plate and an upper vault, and a back wall;

a metallic distribution sheet adjacent the back wall defining a cavity with said back wall in which there is mounted a bladed turbine;

a shaft supporting said bladed turbine, passing through the back wall to be driven by an electrical motor on the opposite side of the cavity, said metallic sheet including orifices distributed so as to permit convection, forced by the turbine, of a stream of air drawn through the central part of the metallic sheet and expelled in the vicinity of its lateral sides; and, at least one source of microwave frequency waves situated outside the muffle having a waveguide output which opens into the muffle through at least one exit iris, the waveguide exit iris being situated in the back wall of the muffle facing a passage provided in the metallic distribution sheet, whereby a wave flux exiting said iris is divided into a first portion which exits said facing passage and a second portion, said second portion being distributed in the cavity behind the metallic sheet, where the turbine of the fan is situated, striking the blades of said turbine, and exiting holes pierced in the metallic sheet toward the interior of the muffle.

2. A cooking oven according to claim 1, wherein the holes arranged in the metallic distribution sheet for distributing the microwaves towards the interior of the muffle have an elongate shape, and produce, when the waves pass through them, a rotated quadrature filed in line with the guide exit iris and with the facing passage provided in the distribution sheet.

3. A cooking oven according to claim 2, wherein the holes in the distribution sheet have an oblong shape with their major axis vertical, perpendicular to the horizontal transverse direction of the longest dimension of the wave guide.

4. A cooking oven according to claim 2, wherein the holes in the distribution sheet are arranged uniformly around the centre of this sheet.

5. A cooking oven according to claim 2, wherein the holes in the distribution sheet have an inclination tangent to concentric circles arranged around the centre of the distribution sheet.

6. A cooking oven according to claim 2, wherein the holes in the distribution sheet are inclined to the vertical and arranged quincuncially.

7. A cooking oven according to claim 2, wherein the holes in the distribution sheet consist of a single central hole in combination with perforations arranged in the lateral sides, and the lower side of the sheet.

8. A cooking oven according to claim 1, wherein the guide exit iris and the facing passage provided in the distribution sheet are closed by small plates of a material which is transparent to microwaves.

9. A cooking oven according to claim 8, wherein the material of the small plates is mica.

10. A cooking oven according to claim 8, wherein the exit iris and the facing passage have relative dimensions determined to ensure a suitable impedance match and are arranged in the vicinity of the vault of the muffle, in the middle part of the latter.

11. A cooking oven according to claim 1, wherein the source of microwave frequency waves, consists of a magnetron.

12. A cooking oven according to claim 1, wherein the turbine shaft driven by the motor is shielded with a quarter-wave trap, preventing microwave energy leakages along this shaft to the exterior of the muffle.

13. A cooking oven according to claim 1, wherein the distribution sheet is made of a material having low dielectric losses.

* * * * *